United States Patent [19]

Bühren et al.

[11] Patent Number: 4,685,630

[45] Date of Patent: Aug. 11, 1987

[54] METHOD AND DEVICE FOR SUPPLYING AN AUTOMATIC WINDING MACHINE WITH BOBBINS

[75] Inventors: Heinz Bühren; Winfried Schumacher, both of Moenchengladbach, Fed. Rep. of Germany

[73] Assignee: W. Schlafhorst & Co., Moenchengladbach, Fed. Rep. of Germany

[21] Appl. No.: 828,302

[22] Filed: Feb. 11, 1986

[30] Foreign Application Priority Data

Feb. 13, 1985 [DE] Fed. Rep. of Germany ..... 3504883

[51] Int. Cl.[4] ..... B65H 54/20; B65H 67/06

[52] U.S. Cl. ..... 242/35.5 A

[58] Field of Search ..... 242/35.5 A, 35.5 R, 242/35.6 R

[56] References Cited

U.S. PATENT DOCUMENTS

| | | | |
|---|---|---|---|
| 3,279,710 | 10/1966 | Raasch | 242/35.5 R |
| 3,480,128 | 11/1969 | Brouwer et al. | 242/35.5 R X |
| 3,774,859 | 11/1973 | Brouwer et al. | 242/35.5 A X |
| 3,933,320 | 1/1976 | Tsurumi et al. | 242/35.5 R |
| 3,998,397 | 12/1976 | Haberkorn et al. | 242/35.5 A |
| 4,212,433 | 7/1980 | Matsui et al. | 242/35.5 A |
| 4,558,829 | 12/1985 | Aretz et al. | 242/35.5 A |

*Primary Examiner*—Stanley N. Gilreath

*Attorney, Agent, or Firm*—Herbert L. Lerner; Laurence A. Greenberg

[57] ABSTRACT

A method for supplying winding units of an automatic winding machine with bobbins to be unwound from a bobbin feeding device, includes requesting a bobbin from the feeding device at a given winding unit, depositing a given bobbin requested by the given winding unit at a distance from other bobbins onto a conveyor belt running along the winding units, transporting the given bobbin to the given winding unit on the conveyor belt, subsequently removing the given bobbin from the conveyor belt and conducting the given bobbin to the given winding unit with a controllable bobbin removing device of the given winding unit, and preventing bobbin removing devices of winding units other than the given winding unit from diverting the given bobbin and from conducting the given bobbin to the winding units other than the given winding unit, and a device for carrying out the method.

13 Claims, 5 Drawing Figures

METHOD AND DEVICE FOR SUPPLYING AN AUTOMATIC WINDING MACHINE WITH BOBBINS

The invention relates to a method and apparatus for supplying the winding units of an automatic winding machine with bobbins which are to be unwound, from a bobbin feeding device, the bobbins being spaced from each other on a conveyor belt which runs along the winding units, and the bobbins being removed from the conveyor belt and conducted to the respective winding units by bobbin removing devices provided at each winding unit.

It is known from German Published, Non-Prosecuted Application DE-OS No. 27 05 784 to control the bobbin feeding device of the automatic winding machine by means of bobbin removing devices of the individual winding units, in such a way that only as many bobbins are deposited onto the conveyor belt as have been requested by the winding units. The bobbins are deposited and spaced from each other on a conveyor belt at the feeding device, even when the requests arrive at the bobbin feeding device simultaneously or in rapid succession.

A method and a device of this type can reduce the efficienty of the automatic winding machine for the following reasons:

Even during undisturbed operation, the bobbin removing devices located closer to the bobbin feeding device catch and accept the bobbins which were requested by the more distant winding units, so that the winding units located further away from the bobbin feeding device must wait for an unproportionately long time for their bobbin supply. It could be pointed out that as a compansation, the winding units nearer to the bobbin feeding device are supplied that much faster. However, this compensation does not take place if the winding units themselves hold one or more bobbins in reserve, such as in a bobbin magazine with several pockets. In this case the bobbin magazine of the winding units nearer to the bobbin feeding device are very rapidly filled with bobbins, but this is not helpful because the winding operation proceeds continuously anyway due to the bobbins stored in the magazine. In contrast, a winding unit further away from the bobbin feeding device in some cases might have to wait until its bobbin magazine is empty and the winding unit can no longer produce. Thus, the winding operation is disturbed or interrupted and the degree of efficiency of the whole machine is lovered.

This disadvantage leads to other initially unrecognized losses, in case a bobbin jumps off the conveyor belt. This can easily happen, if a bobbin removing device operates at the wrong time. After such an occurrence, there is always one bobbin missing on the conveyor belt and the winding stations or units most distant are again the most disadvantaged. Since this can happen frequently during one shift in long automatic winding machines with many winding units, a continuous reduction of the efficiency of the automatic winding machine is unavoidable, unless the time invested to monitor the machine is increased. However, this requires considerable costs.

A badly timed bobbin removing device may also cause the bobbin to become jammed accidentally on the conveyor belt or against its lateral guides, in which case not only the bobbin removal but also the further transportation of the bobbins is blocked.

It is accordingly an object of the invention to provide a method and device for supplying an automatic winding machine with bobbins, which overcomes the hereinafore-mentioned disadvantages of the heretofore-known devices of this general type, and to guarantee the effective supply of the winding units of an automatic winding machine with bobbins which are to be unwound.

With the foregoing and other objects in view there is provided, in accordance with the invention, a method for supplying winding units of an automatic winding machine with bobbins to be unwound from a bobbin feeding device, which comprises requesting a bobbin from the feeding device at a given winding unit, depositing a given bobbin requested by the given winding unit at a distance from other bobbins onto a conveyor belt running along the winding units, transporting the given bobbin to the given winding unit on the conveyor belt, subsequently removing the given bobbin from the conveyor belt and conducting the given bobbin to the given winding unit with a controllable bobbin removing device of the given winding unit, and preventing bobbin removing devices of winding units other than the given winding unit from diverting the given bobbin and from conducting the given bobbin to the winding units other than the given winding unit.

In accordance with another mode of the invention, there is provided a method which comprises releasing the bobbin removing device of the given winding unit for removing the given bobbin only when the given bobbin arrives or is expected to arrive at the bobbin removing device and no disturbance occurs in the operation of the machine.

In accordance with a further mode of the invention, there is provided a method which comprises transporting the given bobbin to the given winding unit in a given time period, and releasing the bobbin removing device of the given winding unit for removing the given bobbin after the given time period has elapsed.

In accordance with an added mode of the invention, there is provided a method which comprises transporting the given bobbin from the feeding device to the given winding unit over a given distance, and releasing the bobbin removing device of the given winding unit for removing the given bobbin only if the conveyor belt has travelled the given distance after the given bobbin was deposited on the conveyor belt.

In accordance with an additional mode of the invention, there is provided a method which comprises transporting the given bobbin past a predetermined number of counting pulse emitting sensors of a counting device, and releasing the bobbin removing device of the given winding unit for removing the given bobbin only if the given bobbin on the conveyor belt has passed the predetermined number of sensors.

With the objects of the invention in view, there is also provided a device for supplying winding units of an automatic winding machine with bobbins to be unwound from a bobbin feeding device, comprising a conveyor belt running along the winding units for carrying mutually spaced apart bobbins from the feeding device to the winding units, controllable bobbin removing devices each being disposed at a respective one of the winding units for removing bobbins from the conveyor belt and conducting them to a respective winding unit, a timing device for controlling the bobbin removing devices by beginning a time count at the start of transport of a bobbin on the conveyor belt and by being set for a transport time of the bobbin to a winding unit requiring a bobbin, and an operative connection between the timing device and the bobbin removing devices.

With the objects of the invention in view, there is furthermore provided a device for supplying winding units of an automatic winding machine with bobbins to be unwound from a bobbin feeding device, comprising a conveyor belt running along the winding units for carrying mutually spaced apart bobbins from the feeding device to the winding units, controllable bobbin removing devices each being disposed at a respective one of the winding units for removing bobbins from the conveyor belt and conducting them to a respective winding unit, a path length measuring device for releasing the bobbin removing devices for removing a bobbin by being set to the length of travel between the bobbin feeding device and a respective winding unit and by measuring the distance covered by the conveyor belt from the beginning of transport of a bobbin to a winding unit requiring the bobbin, and an operative connection between the path length measuring device and the bobbin removing devices.

With the objects of the invention in view, there is additionally provided a device for supplying winding units of an automatic winding machine with bobbins to be unwound from a bobbin feeding device, comprising a conveyor belt running along the winding units for carrying mutually spaced apart bobbins from the feeding device to the winding units, controllable bobbin removing devices each being disposed at a respective one of the winding units for removing bobbins from the conveyor belt and conducting them to a respective winding unit, counting pulse emitting sensors disposed along the conveyor belt for emitting pulses as the bobbins pass by in a given travel direction, a counter connected to the sensors, and an operative connection between the counter and the bobbin removing devices, the counter receiving pulses from the sensors from the start of transport of a bobbin required by a winding unit, and the counter releasing the bobbin removing device for removing a bobbin only if the counter acknowledges input from all of the sensors along the conveyor belt from the bobbin feeding device to a respective winding unit in a sequence determined by the given transport direction.

In accordance with again another feature of the invention, the number of sensors is equal to the number of winding units, and each of the sensors is disposed at a given distance upstream of a respective one of the winding units, as seen in the given transport direction, for taking control and switching times of the bobbin removing devices into consideration.

In accordance with a concomitant feature of the invention, there is provided a drive for the conveyor belt, and disturbance indicators, each of the bobbin removing devices includes a respective registering sensor operatively connected to the drive and to the disturbance indicator for selectively indicating a malfunction and stopping the conveyor belt if a bobbin has not been received at a winding unit with a predetermined time after the bobbin removing device was released.

Due to the feature that each winding unit actually receives the bobbin it requested and because the other winding units are prevented from removing this particular bobbin from the conveyor belt, malfunction due to this reason cannot occur.

Other features which are considered as characteristic for the invention are set forth in the appended claims.

Although the invention is illustrated and described herein as embodied in a method and device for supplying an automatic winding machine with bobbins, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
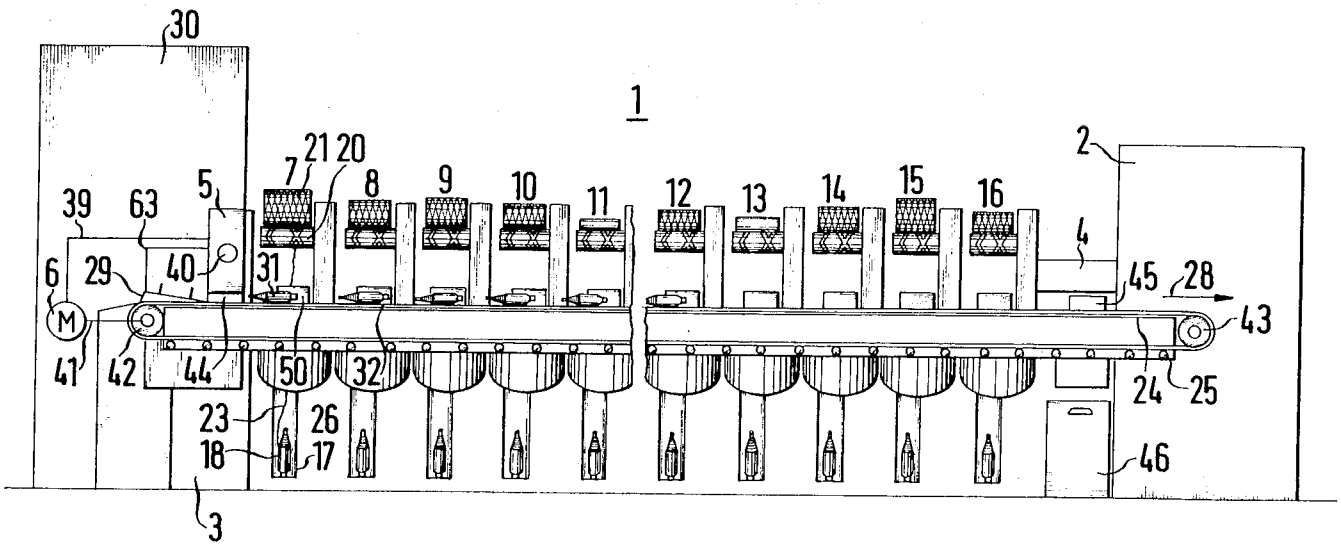
FIG. 1 is a diagrammatic, elevational view of an automatic winding machine.

Referring now to the figures of the drawing in detail and first, particularly, to FIG. 1 thereof, there is seen an automatic winding machine designated as a whole with reference numeral 1. The winding machine includes a rear end frame 2 and a front end frame 3. The end frames are connected to each other by traverses 4. Individual winding or spooling units or stations 7 to 16 are fastened to the end frames.

The most important parts of a winding unit will be further explained using winding unit 7 as an example:

The winding unit 7 is mainly formed of a run-off position 17 for a creel bobbin 18, and a drive roller 20 which is provided with reversing thread grooves for a take-up spool 21 in the form of a cross-wound bobbin or cheese. The reversing thread grooves of the drive roller 20 serve for guiding a thread 23 coming from the bobbin 18. The creel bobbin 18 is in the form of a cop made by a spinning machine.

Part of the winding unit 7 is a cop magazine 26, which is constructed in the form of a round magazine and is attached to a slide 27 (shown in FIGS. 2–5), which leads to the run-off position 17.

A cop feeding device 30 is located at the front end frame 3 and has a cop or bobbin feeder 29 which individually deposits one bobbin or cop 31 at a time onto a conveyor belt 32 which moves in the direction of an arrow 28, as required by the winding units 7 to 16.

The upper run of the conveyor belt 32 slides along a plate 24. The lower run of the conveyor belt is supported by belt rollers 25. Side walls 22, 33 (shown in FIGS. 2–5) serve the purpose of preventing bobbins or cops from falling off the conveyor belt 32 unintentionally.

As shown in FIGS. 2–5, the cop or bobbin magazine 26 has a star-shaped holding element or spider 34 with six arms forming six pockets 35, which can be indexed from pocket to pocket. Three pockets of the bobbin magazine 26 are filled with cops or bobbins 36, 37 and 38, while the other pockets are empty.

The bobbin feeding device 30 includes a control and switching device 5, from which a cable 19 runs, as shown in FIGS. 2–5. The cable 19 serves as a functional or operative connection between the control and switching device 5 and various sensors and activating devices, which will be described below.

For clarification of the drawing, FIG. 1 shows a drive motor 6 of the conveyor belt 32 located at the front and connected to the control and switching device 5 by a control line 39. An optical and acoustical alarm device 40 is provided at the housing of the control and switching device 5 which can be triggered for indication of a disturbance in the bobbin or cop feeding operation.

A functional or operative connection 41 is provided from the drive motor 6 to a front belt roller 42. A rear belt roller 43 serves only for deflecting the conveyor belt 32.

A proximity sensor 44 is located upstream of the bobbin feeder 29, as seen in the transport direction. The switch 44 is connected to the control and switching device 5 by the cable 19 (which is not shown in FIG. 1), and serves for starting several devices.

If, for some reason, too many bobbins or cops are on the .conveyor belt 32, or if the winding units do not remove the bobbins or cops from the conveyor belt in case of a malfunction, the conveyor belt 32 is emptied into a container 46 by means of a bypass device 45. Elements 45 and 46 are disposed downstream of the last winding unit 16, as seen in the transport direction.

Figure 2:
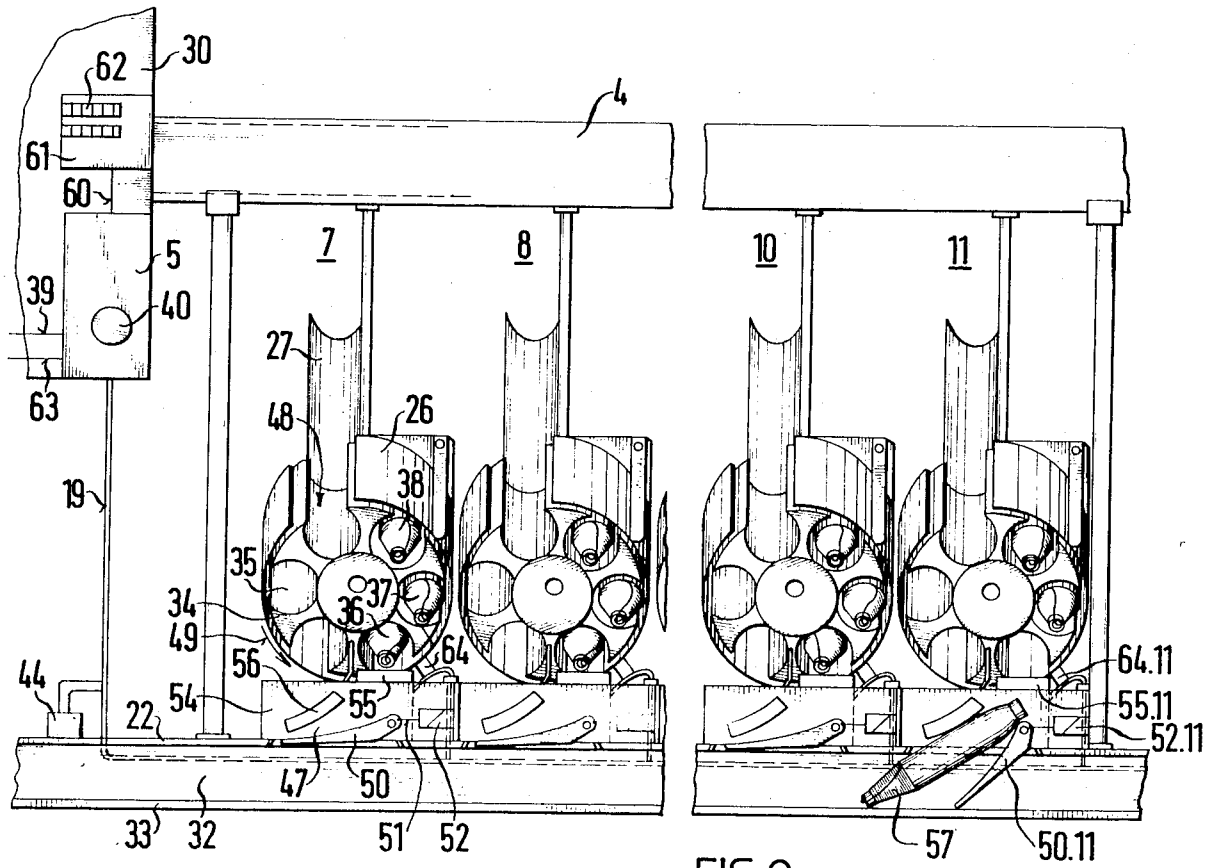
FIG. 2 is a fragmentary, elevational view of a portion of the winding machine on an enlarged scale, showing details of a first embodiment of the invention.
Figure 3:
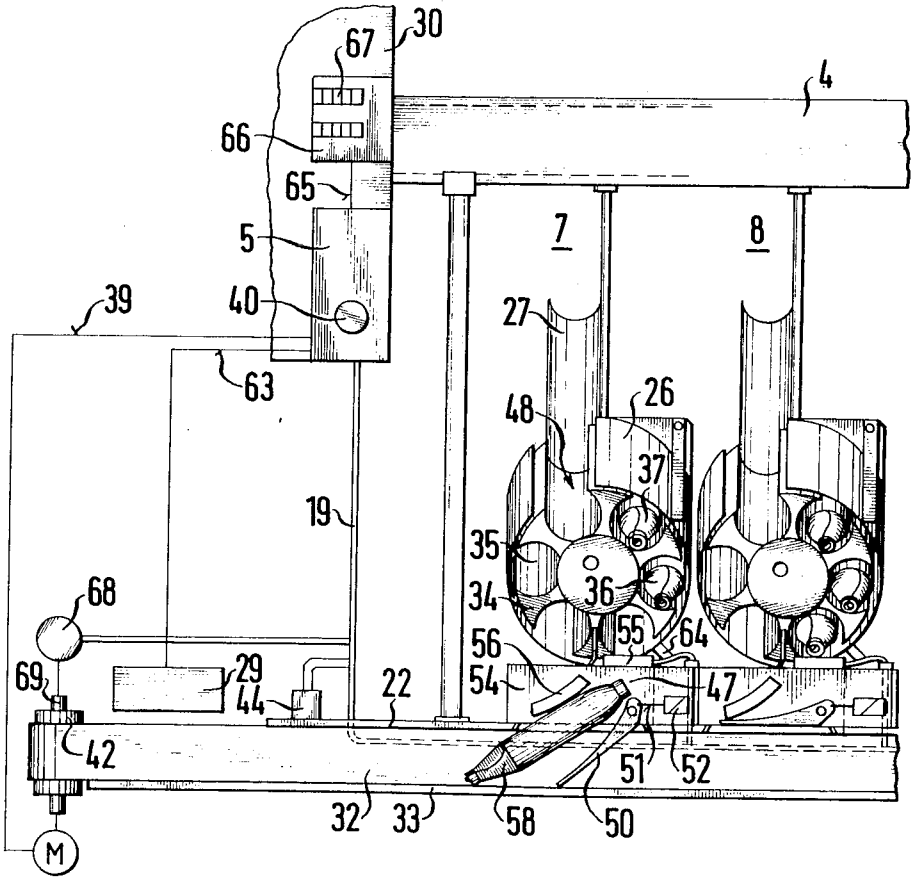
FIG. 3 is a view similar to FIG. 2 showing details of a second embodiment.
Figure 4:
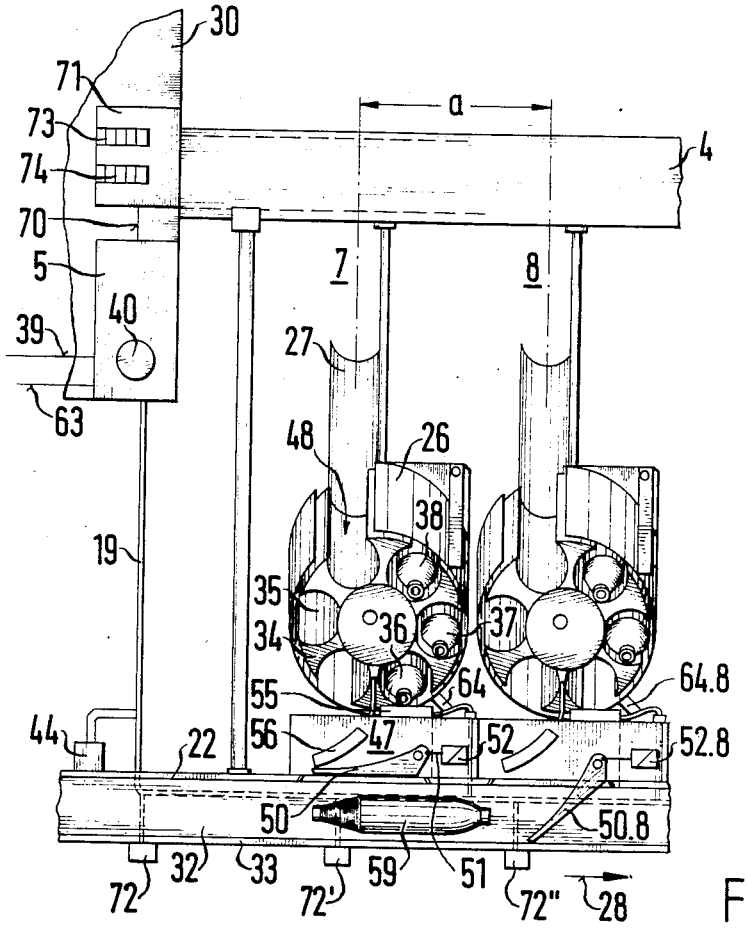
FIG. 4 is a view similar to FIG. 2 showing details of a third embodiment.

FIGS. 2 to 4 show that the winding unit 7 has a given location 47 for filling the cop or bobbin magazine 26 and a given location 48 for discharging the bobbin magazine 26, which is typical for all of the winding units. The discharge of the cop magazine 26 is effected by indexing the holding spider 34 in the direction of an arrow 49, one step at a time. In this way, the bobbin 38 becomes positioned above an opening in the bottom of the holding spider and slides over the chute 27 to the run-off position.

As seen in FIGS. 2–5, a cop or bobbin removal device 50 which is disposed in the filling position 47 can be set to withdraw bobbins from the conveyor belt 32; the device 50 is formed of a controllable deflector. The deflector 50 is connected by a lever 51 to an electromagnetic actuator 52. The electromagnetic actuator 52 is attached to the cable 19.

Figure 5:
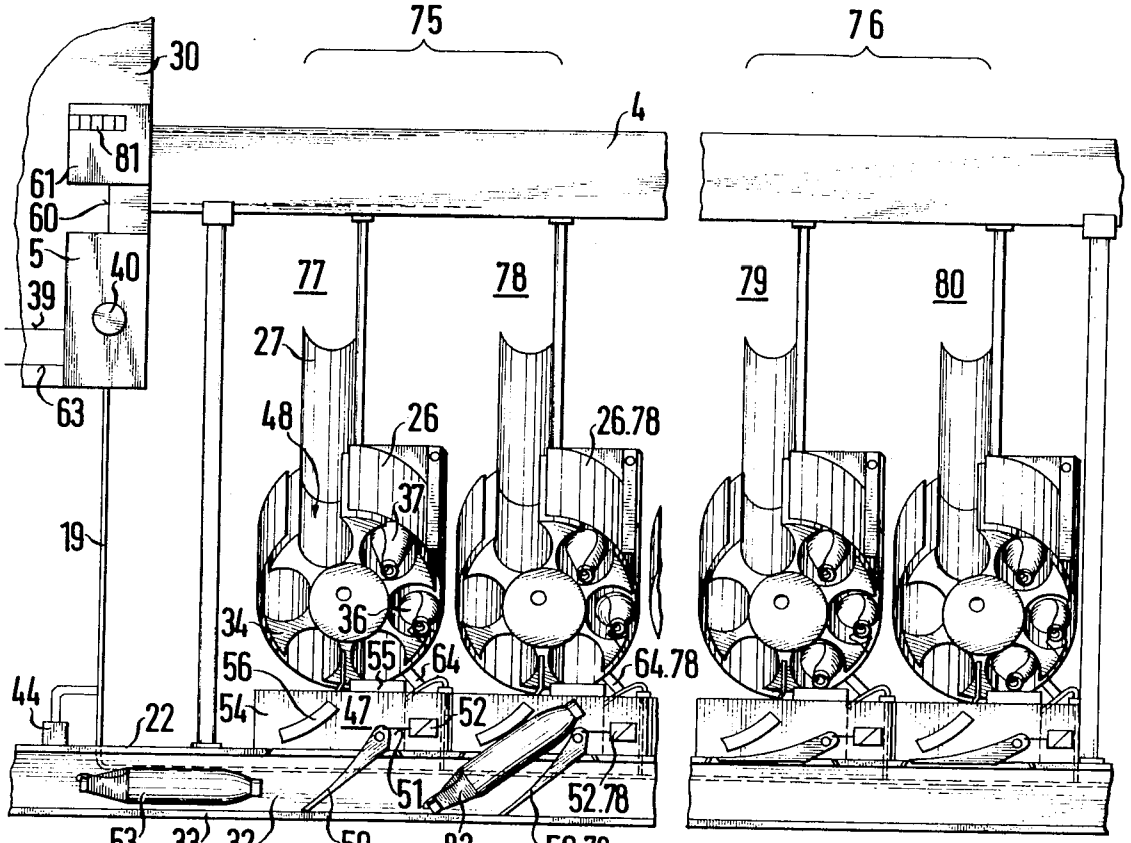
FIG. 5 is a view similar to FIG. 2 showing details of a fourth embodiment.

In FIG. 2 the deflector 50 at the winding unit 7 is in the closed position, while in FIG. 5 the deflector is in the open position, in order to deflect an arriving cop or bobbin 53, and lead it to the bobbin magazine 26. This takes place on an inclined surface 54, and is noted by a sensor such as an acknowledging sensor 55, which is also connected to the cable 19. A guide wall 56 ensures that the cop or bobbin reliably enters into the empty pocket of the holding spider 34.

In the first embodiment of the invention according to FIG. 2, a timing device 61 is connected to the control and switching device 5 through a functional or operative connection 60. A total of ten setting scales, divisions, or graduations 62 for setting the transport times of the cops or bobbins are provided at the timing device 61 corresponding to the number of winding units. Assuming that the conveyor belt runs with uniform speed, a specific transport time of the bobbins can be assigned for each of the ten winding units. The individual transport times can be determined experimentally. The transport time starts as a cop or bobbin passes the proximity sensor 44. The cable 19, the control and switching device 5 and the functional or operative connection 60 give the proximity sensor 44 a functional or operative connection with the timing device 61, so it can start the time count. The length of the travel time of the bobbin is set in such a way that the timing device 61 switches the cop or bobbin removal device 50 for requesting a bobbin when a bobbin has just passed the preceding winding unit. For example, in the position shown in FIG. 2, the winding unit 11 has just requested a cop or bobbin 57 and in this case its deflector 50.11 opens approximately at the point in time when the bobbin 57 passes the preceding winding unit 10.

The request for bobbins is effected by a sensor 64, which continuously monitors the content of the pocket of the holding spider 34 which lies behind the deflector 50. This sensor 64 sends a bobbin request signal to the control and switching device 5 over the cable 19, when an empty pocket is positioned in front of the sensor 64 after indexing the holding spider 34 by one step in the direction of the arrow 49. The control and switching device 5 then gives a bobbin discharge command to the bobbin feeder 29 through the functional or operative connection 63. As soon as the discharged bobbin passes the proximity sensor 44, the time count starts, especially for the winding unit which originated the request, which in this case is the winding unit 11, which is identified by its requesting sensor 64.11.

After the transport time of the bobbin has expired, the timing device 61 sends a command through the cable 19 to the electromagnetic actuator of the deflector, in this case the electromagnetic actuator 52.11. The re-setting of the deflector to the rest position is carried out automatically after a short time delay. During this short time, the sensor which acknowledges the receipt of the bobbin, in this case the sensor 55.11, must recognize the receipt. If this is not the case, the control and switching device 5 issues an alarm and turns off the drive motor 6 of the conveyor belt 32 by means of the control line 39.

While the requested bobbin 57 travels on the conveyor belt 32 to the winding unit 11, the preceding winding unit is prevented from accepting this bobbin. It may be assumed that the control and switching device 5 receives a request for a bobbin from the winding unit 7 immediately after a request for a bobbin by the winding unit 11. In such a case, the bobbin 57 is dispatched corresponding to the sequence in which the requests are received. The second cop or bobbin is dispatched several bobbin lengths behind. The first bobbin therefore will have travelled at least to the position of winding unit 7, before the second bobbin passes the proximity switch 44.

The time advance of the release of the first bobbin is always great enough so that none of the winding units positioned inbetween can catch the bobbin.

The second embodiment according to FIG. 3 differs from the first embodiment as follows:

In FIG. 3, the control and switching device 5 is connected with a path-length measuring device 66 through a functional or operative connection 65. The path-length measuring device 66 has ten setting scales, divisions, or graduations 67 in two rows on top of each other corresponding to the number of winding units, for setting the right path length for the bobbin travel for each winding station. The path length measuring device 66 is connected to a rotational angle measuring device 68 through the cable 19, the control and switching device 5 and a functional or operative connection 65. The rotational angle measuring device 68 is coupled to a shaft 69 of the belt roller 42. A certain rotational angle is always associated with a certain travelled distance of the conveyor belt 32. The rotational angle may be measured, for example, by causing the rotational angle measuring device 68 to send four pulses to the path length measuring device 66 per revolution of the belt roller 42.

When a cop or bobbin 58 which was deposited by the bobbin feeder 29 onto the conveyor belt 32 passes the proximity switch or sensor 44, the sensor 44 sends a starting pulse to the path-length measuring device 66. After receiving a number of pulses corresponding to the preset path length from the rotation angle measuring device 68, the device 66 switches the electromagnetic actuator 52 of the deflector 50 of the winding unit 7 to bobbin discharge, which has been already done, according to FIG. 3.

The third embodiment shown in FIG. 4 differs from the first embodiment shown in FIG. 2 as follows:

The control and switching device 5 is connected to a counter 71 by a functional or operative connection 70. Pulse emitting counters 72, 72', 72" are disposed along the transport path at distances from each other which are equal to the distance between the winding units. There are as many counters as there are winding units.

As seen in the direction of the transport 28, the first pulse emitting counter 72 lies at a distance "a" before the first winding unit 7, the second counter 72' lies at the same distance "a" from the next winding unit 8, and so forth.

All of the pulse sending counters are connected to the cable 19 and thus also have a functional or operative connection to the counting device 71. The counting device 71 has two rows of scales, divisions, or graduations 73 and 74 disposed on top of each other, which are set for a number of counting pulses corresponding to the number of winding units, starting with one, and always progressing by one, so that the first setting scale 73 is set to one, and the last setting scale 74 is set to ten.

In the counting device 71 each winding unit has its own counter or slide register. As the requested bobbin 59 passes by, the counter or register begins to run and the counting device 71 accepts the pulses emitted by the pulse emitting counters 72 in the sequence given by the transport direction 28 when the bobbins pass by, until the predetermined number of counting pulses is reached. The counting device 71 supplies the electromagnetic actuator of the bobbin feeder of the requesting winding unit with electric energy (in this case the actuator 52.8 of the bobbin feeder 50.8) through the functional or operative connection 70, the control and switching device 5 and the cable 19. The bobbin feeder is therefore able to supply a bobbin, i.e. the deflector is opened, as shown in FIG. 4.

The fourth embodiment according to FIG. 5 differs from the first embodiment shown in FIG. 2 as follows:

In FIG. 5 the automatic winding machine has only five winding units, of which only winding units 75 and 76 are shown. Each winding unit is formed of two winding positions. The winding unit 75 includes winding positions 77 and 78 while the winding unit 76 includes winding positions 79 and 80. The timing device 61 has only five setting scales, divisions, or graduations 81 corresponding to the number of winding units. A uniform transport time for each winding unit is set at the timing device 61. For example, a bobbin 53 on the transport band 32 in the position shown in FIG. 5 has just reached the winding unit 75. If the request for a bobbin originates from the winding position 77, the deflector 50 is opened at this point. If the request had originated from the winding position 78, the deflector 50.78 would have opened at this moment.

According to FIG. 5, the winding unit 75 has given two bobbin requests in succession to the control and switching device 5, the first one through the sensor 64.78 and the second one through the sensor 64. In spite of the equal transport time, the bobbin magazine 26.78 of winding unit 78 receives the bobbin 82 which arrived first on the conveyor belt 32, before the deflector 50 opens, in order to receive the second bobbin 53 which was deposited onto the conveyor belt at a distance from the first bobbin 82.

These explanations make it clear that by combining the winding units into winding stations a reduction of the technical complexity can be achieved without other disadvantageous consequences.

According to FIG. 1, ten winding units are provided for each automatic winding machine. Division lines between the winding units 11 and 12 indicate that the number of winding units per machine can be smaller or considerably greater.

The invention is not limited to the illustrated and described embodiments which were used as examples.

The embodiment according to FIG. 2 can be modified in such a way that means are provided which guarantee the synchronization of the transport time and the transport path. For example, this can be achieved by monitoring the bobbins with special sensors, which use the control and switching device 5 to regulate the speed of the conveyor belt in dependence on the predetermined transport time, for example, or which correct the transport time which is given to the timing device 61, according to the actual speed of the conveyor belt. For example, a microprocessor could function as such a regulating device.

In a different modification, the sensor 55 which acknowledges the receipt of a bobbin or cop which is present at each bobbin receiving device, could also be used for closing the deflector.

In the case of a malfunction requiring the conveyor belt 32 to be stopped, it is advantageous to store all of the already activated transport times and transport paths, so that after repairing the problem and manual restarting of the conveyor belt 32, the feeding of the automatic winding machine with bobbins can continue as if the problem had never occurred. Such a malfunction can be easily detected, because the deflector remains open at the malfunctioning winding unit, while all other deflectors are closed. The malfunctioning unit can be recognized even from a distance due to this feature.

The proximity sensor 44 which serves as the starting sensor can also serve to open the bobbin feeder 29, in which case it would be assured that the bobbins or cops are not deposited onto the conveyor belt 32 too closely together. It is sufficient to hold the deflector open for about one second. Within this time one bobbin must have passed the deflector.

Any disturbance of the transport system leads to an indication of the malfunction in a very short time. For example, if one bobbin is taken from the belt or accidentally falls from the belt, the requesting winding unit does not receive this bobbin, and its receipt monitoring sensor 55 announces this disturbance.

We claim:

1. Method for supplying winding units of an automatic winding machine with bobbins to be unwound from a bobbin feeding device, which comprises requesting a bobbin from the feeding device at a given winding unit, depositing a given bobbin requested by the given winding unit at a distance from other bobbins onto a conveyor belt running along the winding units, transporting the given bobbin to the given winding unit on the conveyor belt, subsequently removing the given bobbin from the conveyor belt and conducting the given bobbin to the given winding unit with a controllable bobbin removing device of the given winding unit, and preventing bobbin removing devices of winding units other than the given winding unit from diverting the given bobbin and from conducting the given bobbin to the winding units other than the given winding unit.

2. Method according to claim 1, which comprises releasing the bobbin removing device of the given winding unit for removing the given bobbin only when the given bobbin arrives at the bobbin removing device and no disturbance occurs in the operation of the machine.

3. Method according to claim 1, which comprises releasing the bobbin removing device of the given winding unit for removing the given bobbin only when the given bobbin is expected to arrive at the bobbin removing device and no disturbance occurs in the operation of the machine.

4. Method according to claim 1, which comprises transporting the given bobbin to the given winding unit in a given time period, and releasing the bobbin removing device of the given winding unit for removing the given bobbin after the given time period has elapsed.

5. Method according to claim 1, which comprises transporting the given bobbin from the feeding device to the given winding unit over a given distance, and releasing the bobbin removing device of the given winding unit for removing the given bobbin only if the conveyor belt has travelled the given distance after the given bobbin was deposited on the conveyor belt.

6. Method according to claim 1, which comprises transporting the given bobbin past a predetermined number of counting pulse emitting sensors of a counting device, and releasing the bobbin removing device of the given winding unit for removing the given bobbin only if the given bobbin on the conveyor belt has passed the predetermined number of sensors.

7. Device for supplying winding units of an automatic winding machine with bobbins to be unwound from a bobbin feeding device, comprising a conveyor belt running along the winding units for carrying mutually spaced apart bobbins from the feeding device to the winding units, sensors each being disposed at a respective one of said winding units for requesting a bobbin, controllable bobbin removing devices each being disposed at a respective one of said winding units and being movable between a first position for permitting bobbins on said conveyor belt to bypass a respective winding unit and a second position for removing bobbins from the conveyor belt and conducting them to a respective winding unit, a timing device for controlling the bobbin removing devices by beginning a time count at the start of transport of a bobbin on the conveyor belt and by being set for a transport time of the bobbin to a winding unit requiring a bobbin, and an operative connection between the timing device and the bobbin removing devices for actuating said bobbin removal devices of a respective winding unit requiring said bobbin removing devices to move to said second position for removing bobbins from said conveyor belt.

8. Device for supplying winding units of an automatic winding machine with bobbins to be unwound from a bobbin feeding device, comprising a conveyor belt running along the winding units for carrying mutually spaced apart bobbins from the feeding device to the winding units, sensors each being disposed at a respective one of said winding units for requesting a bobbin, controllable bobbin removing devices each being disposed at a respective one of said winding units and being movable between a first position for permitting bobbins on said conveyor belt to bypass a respective winding unit and a second position for removing bobbins from the conveyor belt and conducting them to a respective winding unit, a path length measuring device for releasing said bobbin removing devices for removing a bobbin by being set to the length of travel between the bobbin feeding device and a respective winding unit and by measuring the distance covered by said conveyor belt from the beginning of transport of a bobbin to a winding unit requiring the bobbin, and an operative connection between said path length measuring device and said bobbin removing devices for actuating said bobbin removal devices of a respective winding unit requiring said bobbin removing devices to move to said second position for removing bobbins from said conveyor belt.

9. Device for supplying winding units of an automatic winding machine with bobbins to be unwound from a bobbin feeding device, comprising a conveyor belt running along the winding units for carrying mutually spaced apart bobbins from the feeding device to the winding units, sensors each being disposed at a respective one of said winding units for requesting a bobbin, controllable bobbin removing devices each being disposed at a respective one of said winding units and being movable between a first position for permitting bobbins on said conveyor belt to bypass a respective winding unit and a second position for removing bobbins from the conveyor belt and conducting them to a respective winding unit, counting pulse emitting sensors disposed along said conveyor belt for emitting pulses as the bobbins pass by in a given travel direction, a counter connected to said sensors, and an operative connection between said counter and said bobbin removing devices, said counter receiving pulses from said sensors from the start of transport of a bobbin required by a winding unit, and said counter releasing said bobbin removing device for removing a bobbin only if said counter acknowledges input from all of said sensors along said conveyor belt from the bobbin feeding device to a respective winding unit in a sequence determined by the given transport direction for actuating said bobbin removal devices of a respective winding unit requiring said bobbin removing devices to move to said second position for removing bobbins from said conveyor belt.

10. Device according to claim 9, wherein the number of sensors is equal to the number of winding units, and each of said sensors is disposed at a given distance upstream of a respective one of said winding units, as seen in the given transport direction, for compensating for control and switching times of said bobbin removing devices.

11. Device according to claim 7, including a drive for said conveyor belt, and disturbance indicators, each of said bobbin removing devices includes a respective registering sensor operatively connected to said drive and to said disturbance indicator for selectively indicating a malfunction and stopping said conveyor belt if a bobbin has not been received at a winding unit with a predetermined time after said bobbin removing device was released.

12. Device according to claim 8, including a drive for said conveyor belt, and disturbance indicators, each of said bobbin removing devices includes a respective registering sensor operatively connected to said drive and to said disturbance indicator for selectively indicating a malfunction and stopping said conveyor belt if a bobbin has not been received at a winding unit with a predetermined time after said bobbin removing device was released.

13. Device according to claim 9, including a drive for said conveyor belt, and disturbance indicators, each of said bobbin removing devices includes a respective registering sensor operatively connected to said drive and to said disturbance indicator for selectively indicating a malfunction and stopping said conveyor belt if a bobbin has not been received at a winding unit with a predetermined time after said bobbin removing device was released.

* * * * *